US010181678B2

(12) United States Patent
Pemwieser

(10) Patent No.: US 10,181,678 B2
(45) Date of Patent: Jan. 15, 2019

(54) PLUG CONNECTION

(71) Applicant: Rosenberger Hochfrequenztechnik GmbH & Co. KG, Fridolfing (DE)

(72) Inventor: Manuel Pemwieser, Burghausen (DE)

(73) Assignee: Rosenberger Hochfriquenztechnik GmbH & Co., KG, Fridolfing (DE)

( * ) Notice: Subject to any disclaimer, the term of this patent is extended or adjusted under 35 U.S.C. 154(b) by 0 days.

(21) Appl. No.: 15/775,615

(22) PCT Filed: Sep. 15, 2017

(86) PCT No.: PCT/EP2017/073247
§ 371 (c)(1),
(2) Date: May 11, 2018

(87) PCT Pub. No.: WO2018/072940
PCT Pub. Date: Apr. 26, 2018

(65) Prior Publication Data

US 2018/0309235 A1 Oct. 25, 2018

(30) Foreign Application Priority Data

Oct. 20, 2016 (DE) ..... 10 2016 120 063

(51) Int. Cl.
*H01R 13/627* (2006.01)
*H01R 13/629* (2006.01)
*H01R 13/631* (2006.01)

(52) U.S. Cl.
CPC ... *H01R 13/62911* (2013.01); *H01R 13/6271* (2013.01); *H01R 13/62927* (2013.01); *H01R 13/631* (2013.01)

(58) Field of Classification Search
CPC ..... H01R 13/62911; H01R 13/62927; H01R 13/6271; H01R 13/631
(Continued)

(56) References Cited

U.S. PATENT DOCUMENTS 3,319,547 A * 5/1967 Petts ..... G03B 15/0431 362/10
4,449,778 A * 5/1984 Lane ..... H01R 9/032 439/607.47
(Continued)

FOREIGN PATENT DOCUMENTS

DE 196 04 862 A1 8/1996
DE 198 02 554 A1 8/1999
(Continued)

OTHER PUBLICATIONS

International Search Report and Written Opinion of International Searching Authority in connection with International Application No. PCT/EP2017/073247 (14 pages).

*Primary Examiner* — Abdullah Riyami
*Assistant Examiner* — Nelson R Burgos-Guntin
(74) *Attorney, Agent, or Firm* — GrayRobinson, P.A.; Donald S. Showalter

(57) ABSTRACT

A preferred embodiment of a plug connection apparatus includes a first plug connector, a second plug connector and a connection installation element mounted on a housing of the first plug connector by way of a guide. The connection installation element has a first gate part and a housing of the second plug connector has a second gate part. The gate parts assume a first mutually relative position when the plug connectors are plugged to one another in a preliminary latching position. The plug connectors are mechanically coupled by way of the guide and the gate parts such that the plug connectors are plugged to one another in a terminal position when the two gate parts are in a second mutually relative position. The connection is displaceable from an unlocking position to a locking position to displace the gate parts to the second position.

14 Claims, 5 Drawing Sheets

(58) Field of Classification Search
USPC ..... 439/325, 357, 358, 263, 347, 385, 682, 439/350, 689
See application file for complete search history.

(56) References Cited

U.S. PATENT DOCUMENTS

| | | | | |
|---|---|---|---|---|
| 4,998,884 | A * | 3/1991 | Ishikawa | H01R 13/629 439/358 |
| 5,779,495 | A * | 7/1998 | Dechelette | H01R 13/6275 439/352 |
| 5,928,011 | A * | 7/1999 | Flask | H01R 13/4362 439/157 |
| 6,176,723 | B1 * | 1/2001 | Sakata | H01R 12/83 439/326 |
| 6,312,277 | B1 * | 11/2001 | Holub | H01R 13/6272 439/352 |
| 6,332,795 | B1 * | 12/2001 | Conorich | H01R 13/62933 439/188 |
| 6,346,002 | B1 * | 2/2002 | Hsu | H01R 13/6275 439/352 |
| 6,416,345 | B1 * | 7/2002 | Endo | H01R 13/6272 439/352 |
| 6,561,699 | B1 * | 5/2003 | De Marchi | G02B 6/3825 385/58 |
| 6,682,359 | B1 * | 1/2004 | Hitchcock | H01R 13/62944 439/153 |
| 6,739,889 | B1 * | 5/2004 | Daggett | H01R 13/62938 439/157 |
| 6,860,750 | B1 * | 3/2005 | Wu | H01R 13/6275 439/357 |
| 7,789,690 | B1 * | 9/2010 | Rhein | H01R 13/53 439/310 |
| 7,828,585 | B2 * | 11/2010 | Kurimoto | H01R 13/02 439/357 |
| 8,235,744 | B1 * | 8/2012 | Liptak | H01R 13/639 439/352 |
| 8,968,021 | B1 * | 3/2015 | Kennedy | H01R 13/6273 439/352 |
| 9,039,438 | B2 * | 5/2015 | Gunreben | H01R 13/6273 439/352 |
| 2001/0021603 | A1 * | 9/2001 | Chen | H01R 13/6271 439/358 |
| 2002/0081888 | A1 * | 6/2002 | Regnier | H01R 13/6273 439/352 |
| 2003/0176104 | A1 | 9/2003 | Hall et al. | |
| 2005/0003696 | A1 * | 1/2005 | Shirk | H01R 13/627 439/352 |
| 2007/0232140 | A1 * | 10/2007 | Tyler | H01R 13/506 439/587 |
| 2009/0269963 | A1 * | 10/2009 | Brown | H01R 13/4223 439/357 |
| 2010/0323537 | A1 * | 12/2010 | Vasbinder | H01R 13/62922 439/65 |
| 2011/0080008 | A1 * | 4/2011 | Teo | H01R 13/6272 292/197 |
| 2013/0323955 | A1 * | 12/2013 | Nishio | H01R 12/732 439/325 |
| 2014/0302703 | A1 * | 10/2014 | Wu | H01R 13/62966 439/372 |
| 2014/0322948 | A1 * | 10/2014 | Blakborn | H01R 13/627 439/350 |
| 2015/0104967 | A1 * | 4/2015 | Jaan | H01R 13/6275 439/352 |
| 2016/0036179 | A1 * | 2/2016 | Bragg | H01R 24/64 439/391 |
| 2016/0118745 | A1 * | 4/2016 | Droesbeke | H01R 13/4368 385/76 |

FOREIGN PATENT DOCUMENTS

| | | |
|---|---|---|
| DE | 198 20 424 A1 | 11/1999 |
| DE | 11 2012 001 061 T5 | 12/2013 |
| DE | 20 2013 000 877 U1 | 6/2014 |
| EP | 0 801 441 A1 | 3/1997 |
| EP | 1 081 802 A1 | 3/2001 |
| EP | 1 708 313 A2 | 10/2004 |

* cited by examiner

PLUG CONNECTION

CROSS REFERENCE TO RELATED APPLICATIONS

This is a U.S. National Phase Entry under 35 U.S.C. § 371 of International Application No. PCT/EP2017/073247 filed Sep. 15, 2017 entitled: PLUG CONNECTION which designated the United States and at least one other country in addition to the United States and claims priority to German Patent Application No. 10 2016 120 063.8 filed Oct. 20, 2016.

INCORPORATION BY REFERENCE

International Application No. PCT/EP2017/074347 and German Patent Application No. 10 2016 120 063.8 are each expressly incorporated herein by reference in their entireties to form part of the present disclosure.

STATEMENT REGARDING FEDERALLY-SPONSORED RESEARCH OR DEVELOPMENT

Not applicable.

FIELD OF THE INVENTION

The invention relates to the field of electrical plug connection devices of the type having a first plug connector and a second plug connector which are capable of being plugged to one another for establishing a mechanical and electrical connection.

BACKGROUND

In the assembly of cables, the conductors thereof are typically connected using a plug connector. The plug connector can be a plug, an installation plug, a socket, a coupler or an adapter. The term plug connector used in the context of the invention represents all variants.

A plug connector serves for establishing an electrical connection to a respective, complementary further plug connector.

In particular plug connectors for the automotive industry, or for vehicles, are set high requirements in terms of the robustness of said plug connectors and in terms of the reliability of the plug connection. A plug connection thus has to at times withstand high stresses, for example mechanical stresses or thermal stresses, and be closed in a defined manner such that the electrical connection is not inadvertently cut, for example during the operation of a vehicle. The guarantee of reliability is paramount in particular in the case of a (partially) autonomous operation of vehicles and for assistance systems.

For example, in the case of an autonomous operation of a vehicle, or in the case of the use of assistance systems, high quantities of data from a plurality of cameras, various sensors, and navigational sources have at times to be combined with one another and transported, usually in real-time. The operation of many apparatuses, screens, and cameras accordingly requires a high-capacity infrastructure in the vehicle electronics. Accordingly, the requirements set for the plug connectors and for the cable connections in terms of the required data rate within a vehicle have in the meantime been set very high. At the same time it is important that the plug connectors are configured so as to be as compact as possible in order for installation space and weight to be saved.

The present invention is not limited to the use in a vehicle, wherein the term vehicle comprises any transportation means in the context of the invention, in particular terrestrial (e.g. motor vehicles), nautical, or aeronautical vehicles, including spacecraft.

The invention is not limited to a specific plug connection, or to a specific plug connector, respectively, although the invention is particularly suitable for high bit-rate plug connectors (HF plug connectors). The plug connector can in particular be configured as a PL plug connector, a BNC plug connector, a TNC plug connector, a SMBA(FAKRA) plug connector, a N plug connector, a 7/16 plug connector, a SMA plug connector, a SMB plug connector, a SMS plug connector, a SMC plug connector, or a SMP plug connector.

The plug connection can preferably be configured as a so-called HFM ("High Speed FAKRA Mini") plug connection. It is known from the prior art that plug connections of this type having frequencies up to 15 GHz and data rates up to 20 Gbit/s can be used. At the same time, the plug connectors are configured so as to be extremely compact and space-saving, for example as compared to the conventional FAKRA standard.

It is known from practice that snap-fit connections which (in a mechanically releasable manner) fix the plug connection in the plugged-together state are provided for plug connectors. For example, a coaxial plug connector having a plastics housing, which corresponds to the so-called FAKRA standardization scheme for SMB connections and discloses a snap-fit connection is known from US 2003/0176104 A1.

For BNC plug connectors, reference to this end being made, for example, to the coaxial plug connector disclosed in DE 20 2013 000 877 U1, it is furthermore known for the plug connection to be mechanically secured by a bayonet fitting. The bayonet fitting is implemented in that one of the plug connectors configures a protrusion, while a bayonet nut having a helical groove is configured on the head of the other plug connector. The protrusion can be introduced into the helical groove. The bayonet fitting is then closed by rotating the bayonet nut, so as to connect the two plug connectors secured inside one another. However, BNC plug connectors are not suitable for all applications, and are typically usable only for transmitting signals at frequencies up to 4 GHz.

It has been demonstrated in practice that the mechanical fixing of the plug connection substantially influences the quality of the electrical connection, for example on account of the electromagnetic tightness or shielding, respectively, and the assurance of a stable, vibration-proof and thus also low-resistance contact face. It has been demonstrated herein that the known snap-fit connections do not offer any satisfying solutions for achieving comparatively high data rates, or comparatively high transmission frequencies, respectively.

BRIEF SUMMARY OF THE INVENTION

The present invention is based on the object of achieving a particularly reliable and easy-to-operate plug connection, in particular for use at high data rates, while maintaining a compact installation space.

A plug connection apparatus according to the invention comprises a first plug connector and a second plug connector which, for establishing a mechanical and electrical connection, are capable of being plugged to one another. The plug connection apparatus furthermore comprises an additional connection installation element which, for supporting the connection of the plug connectors, is disposed on a housing of the first plug connector.

Moreover, the plug connectors for special applications can have even further means for establishing the mechanical and electrical connection, for example based on a force-fit or a form-fit between respective components of the plug connectors. Furthermore, a mechanical and/or magnetic coding feature can be provided, on account of which only mutually corresponding plug connectors are capable of being plugged to one another, and/or the plug connectors are capable of being plugged to one another only in a desired orientation.

The connection installation element according to the invention has at least one first gate part, and a housing of the second plug connector has at least one second gate part, which collectively configure a gate guide. The two gate parts of the gate guide herein are disposed and configured in such a manner that the two gate parts assume a first mutually relative position when the plug connectors are plugged to one another in a preliminary latching position.

In as far as reference hereunder is made to the "two" gate parts, this is to be understood as a reference to "at least one first gate part" and to the "at least one second gate part".

The plug connectors in the preliminary latching position are preferably plugged to one another in a first position, but are not yet finally connected in electrical and mechanical terms. The electrical connection in the preliminary latching position can optionally not yet be sufficiently or completely established. This applies in particular also to the shielding. The plug connectors can be moved to the preliminary latching position substantially in that the plug connectors in the conventional manner are axially plugged to one another in the plug-fitting direction without any substantial effort, in particular any particular effort in terms of force, being required. At least individual components of the plug connectors, preferably housing parts or latching elements, preferably already intrude into one another so as to hold the plug connectors loosely (or optionally already in a first fixing mechanism) in the preliminary latching position.

It is furthermore provided according to the invention that the connection installation element is connected to the housing of the first plug connector by way of at least one guide.

The connection installation element can thus be moved along the guide on the housing, or moved relative to the housing of the first plug connector, respectively.

The plug connectors by way of the guide and the gate guide are mechanically coupled in such a manner that the plug connectors are plugged to one another in a terminal position when the two gate parts are in a second mutually relative position.

It can be provided that one of the gate parts has an opening, or a positioning system region, respectively, or a receptacle, respectively, so as to receive the corresponding gate part at the end side, that is to say in the plug-fitting direction, or in the axial direction, respectively, when the plug connectors are plugged to one another in the preliminary latching position. Subsequently, the gate part received can be preferably positively guided within the receiving gate part, on account of which a conventional gate guide can consequently be provided.

On account of the connection installation element being mechanically connected to the housing of the first plug connector by way of the guide, and the second plug connector being connected to the connection installation element by the gate guide, a mechanical connection between the housings of the plug connectors is provided by way of the guide and the gate guide.

According to the invention, the connection installation element by way of the first gate part is displaceable along the guide, relative to the housing of the first plug connector, from an unlocking position to a locking position, so as to displace the two gate parts to the second position.

When the connection installation element is displaced along the guide, relative to the housing of the first plug connector, from the unlocking position to the locking position, this movement leads to the two gate parts being moved to a second mutually relative position. The movement of the connection installation element is consequently transmitted by way of the gate guide to the second plug connector, on account of which the plug connectors move toward one another and are plugged to one another in a terminal position. The plug connectors can thus be moved to the terminal position thereof solely by activating the connection installation. The plug connectors during the relative movement of the connection installation element along the guide preferably move toward one another in the plug-fitting direction.

The connection installation element is preferably configured so as to be at least approximately U-shaped, and on the outside comprises the housing of the first plug connector.

The housing of the first plug connector, and preferably also correspondingly the housing of the second plug connector, when viewed in cross section are preferably angular, preferably configured as rectangles or, particularly preferably, so as to be square. Accordingly, the connection installation element preferably has an adapted U-shape wherein in turn the two guides are in each case preferably configured between a leg of the U-shaped connection installation element and an adjacent housing face of the housing of the first plug connector.

On account of the design according to the invention, the plug connectors can be improved in such a manner that a data transmission at a high data rate is possible, in particular at a rate higher than is possible without additional measures by way of the prior art, in particular by way of the known HFM plug connections.

On account of the improved connection, data at frequencies exceeding 18 GHz and data rates exceeding 24 Gbit/s can sometimes be transmitted.

On account of an additional connection installation element being used, an exact electrical and mechanical connection of the plug connection can be guaranteed even at high other tolerances of the installation parts. The plug connection according to the invention is suitable for particularly high electrical requirements and is insensitive to defects, even when the components of the plug connection are burdened with high tolerances.

In the case of conventional latching rockers or snap-fit connections, respectively, which are intended to fix the plug connectors in a terminal position, the tolerances mentioned are of such a size that particularly high data rates cannot be attained without further measures.

The plug connectors according to the invention can be designed so as to be space-saving. To this end, the plug connectors can be configured, for example, as plug connectors for a HFM plug connection.

The plug connector according to the invention can be particularly advantageously used within a vehicle, in particular a motor vehicle. Potential fields of application include autonomous driving, driver assistance systems, navigation systems, infotainment systems, rear-compartment entertainment systems, Internet connections, and wireless gigabit (IEEE 802.11ad standard). Potential applications relate to high-resolution cameras, for example 4K and 8K cameras, sensor systems, on-board computers, high-resolution screens, high-resolution dashboards, 3D navigation apparatuses, and mobile phone apparatuses. The plug connector according to the invention is suitable for arbitrary applications within the entire field of electronics and is not to be understood to be limited to the use in automotive technology.

In one refinement, it can be provided in particular that the plug connectors are configured for a data connection at high bit rates.

By virtue of the improved mechanical and electrical connection in the plugged-together state of the plug connection, the plug connection according to the invention is particularly suitable for transmitting signals at high data rates, since the cost/benefit ratio is the most advantageous in this case.

The plug connectors according to the invention can be configured for an arbitrary plug connection.

In one preferred refinement, the plug connectors can be configured as coaxial plug connectors.

By virtue of the good electrical shielding of a coaxial cable and of the associated coaxial plug connector, a design embodiment of this type is particularly suitable for the plug connection according to the invention.

The first and/or the second plug connector can optionally also be configured as a circuit-board plug connector.

In one refinement, it can be provided that the first plug connector is configured as a coupler or a socket, and the second plug connector is configured as a plug or an installation plug. It can also be provided that the first and/or the second plug connector are/is configured as an adapter.

The plug connectors according to the invention can be configured so as to be straight and/or angled.

The plug connection can be capable for use with cables of arbitrary cable diameters. The plug connection can preferably be capable of use with cables of diameters between 0.5 mm and 10 mm, particularly preferably between 1 mm and 5 mm, and most particularly preferably with cable diameters of 1.2 mm, or 2.9 mm, or 3.6 mm.

The plug connectors can preferably be configured so as to be waterproof, wherein it is in particular provided that the plug connection in the plugged-together state of the plug connectors is waterproof.

The plug connectors can have an arbitrary number of conductors or inner conductors, respectively, a design embodiment for one conductor, two conductors, three conductors, four conductors, five conductors, or more conductors being particularly preferable.

In one refinement of the invention, it can be provided that the connection installation element is captively connected to the first plug connector.

On account thereof, the assembly can be simplified and it can in particular also be prevented that the connection installation element is lost in the procedure of an assembly.

It can be provided that the connection installation element is captively yet nevertheless loosely connected to the first plug connector by way of a securing wire or similar. It can however also be provided that the connection installation element is captively connected to the first plug connector in such a manner that the connection installation element is already in a basic position, or in an unlocking position according to the invention, respectively, in relation to the housing of the first plug connector.

Alternatively, the connection installation element also in the loose state can be provided as part of the plug connection. The connection installation element to this end can be attached to the first plug connector, for example after or before plugging the plug connectors to one another in the preliminary latching position.

In one refinement of the invention, it can be provided that the connection installation element has at least one detent element, and the housing of the first plug connector has at least one detent, so as to delimit a movement of the connection installation element along the guide in a direction from the unlocking position to the locking position and/or in the opposite direction.

On account of this design, the connection installation element can be connected to the housing of the first plug connector so as to be captive in at least one of the directions of movement of said connection installation.

The detent element of the connection installation element can preferably be configured as a tab or a protrusion. The detent element in the plug-fitting direction preferably protrudes to the rear beyond the basic shape of the connection installation, so as to interact with the detent.

It can also be provided that only one detent element and one detent are provided so as to delimit the movement of the connection installation element in one direction. This type of delimitation can be of advantage, for example, when the connection installation element by other means is held in such a manner that the connection installation element can be lost in only one direction in any case.

The connection installation element can preferably have at least one detent element, and the housing of the first plug connector can have at least one detent, so as to delimit a movement of the connection installation element along the guide, from the locking position beyond the unlocking position.

Two or more guides which are preferably designed in an identical manner can be provided.

A plug connection apparatus according to the invention preferably has two guides in such a manner that the connection installation element is preferably guided on two opposite sides of the housing of the first plug connector. The two guides herein are preferably disposed and configured in a mirror-symmetrical manner. A particularly suitable guiding of the connection installation element relative to the housing of the first plug connector results on account thereof.

The connection installation element can be configured so as to be substantially U-shaped. In this case, it can be advantageous when all guide components (in particular the gate guide and the guide) as well as all securing components (in particular the detent, the detent element, the securing member described hereunder, and the unlocking element described hereunder) are disposed, preferably symmetrically, on both sides of the first plug connector, or of the housing of the first plug connector, respectively, or on both sides of the connection installation element on both legs.

In the case of a U-shaped configuration of the connection installation element it can be sufficient for the movement of the connection installation element along the guide to be delimited in only one direction, since the U-shaped configuration already inherently prevents any loss in the opposite direction by way of the face that connects the legs.

In one refinement, it can be provided that the connection installation element has at least one securing member, and the housing of the first plug connector has at least one detent face, wherein the detent face in the unplugged state of the plug connectors prevents any movement of the connection installation element from the unlocking position in the direction toward the locking position.

It can be advantageous to fix the connection installation element in the unlocking position thereof, or in a basic position, respectively. On account thereof, it can be guaranteed that the plug connectors are capable of being comfortably plugged to one another in the preliminary latching position, without the connection installation element having to be activated, or considered, respectively, in any form. On account thereof, the plug connection is particularly easy to handle and less prone to errors in terms of operations.

In one refinement of the invention it can furthermore be provided that the second plug connector has at least one unlocking element which is disposed and configured in such a manner that the at least one unlocking element, when plugging the plug connectors to one another, preferably when reaching the preliminary latching position, moves or manipulates the at least one securing member in such a manner that the securing member and the detent face no longer block the displacement path of the connection installation element from the unlocking position to the locking position.

The unlocking element can be, for example, a particular molding or a protrusion of the housing of the second plug connector.

The unlocking element is preferably a web which protrudes laterally from the housing of the second plug connector and, when plugging the plug connectors to one another, is able to move or manipulate the securing member in such a manner that the securing member is moved out of the displacement path of the connection installation.

On account of the second plug connector having an unlocking element, it can be achieved that the connection installation element is movable from the unlocking position thereof along the guide to the locking position only when correctly used with a corresponding second plug connector. The connection installation element herein by plugging the plug connectors to one another is preferably released in a self-acting manner, preferably as soon as the plug connectors have been moved to the preliminary latching position.

It can be preferably provided that the plug connection is configured so as to be downwardly compatible. In the case of a design embodiment of the plug connectors according to the invention according to the HFM plug connector standard it can be provided for example, that the first and/or the second plug connector also communicate/communicates with a conventional HFM plug connector and are/is capable of being plugged to a plug connector of this type. Even when the connection installation element in this case is optionally not usable (and in this instance is also not unlocked, for example) the downward compatibility can be advantageous for economic reasons.

In one refinement of the invention, the securing member can be configured as a snap-fit hook and be pretensioned in such a manner that at least part of the snap-fit hook in the unplugged state of the plug connectors bears on the detent face of the housing of the first plug connector.

A snap-fit connection has proven particularly advantageous for configuring the securing member. An unlocking element which preferably protrudes from the housing of the second plug connector can thus activate in a simple manner the snap-fit hook or hooks during the plugging of the plug connectors to one another. It can be provided that the snap-fit hook has an introduction region in such a manner that the unlocking element is initially offered up to the snap-fit hook and activates the latter, in particular pushes the latter outward, only when the plug connectors are plugged to one another further. This can be achieved in a simple manner by a corresponding shaping of the snap-fit hook.

To this end, the snap-fit hook can be configured so as to be elastic.

The snap-fit hook can optionally also be configured as a predetermined breaking point in such a manner that the connection installation element is permanently released when the plug connectors are initially plugged to one another.

In one refinement of the invention it can furthermore be provided that both ends of the snap-fit hook are connected to the connection installation.

The inventors have recognized that the plug connection is more robust and less prone to errors when the snap-fit hook is fastened to both ends. On account thereof, the snap-fit hook can still fulfill its function as a securing member even in the case of a comparatively great force acting thereon.

The snap-fit hook can most particularly preferably be configured so as to be angled, preferably in such a manner that a region of the snap-fit hook close to the angle, or the corner, respectively, of the snap-fit hook fulfills the securing function in that the angle, or the corner, respectively, in the displacement path of the connection installation element bears on the detent face of the housing. The connection installation element in this instance can be released in that the unlocking element of the second plug connector pushes the corner out of the displacement path when the plug connectors are plugged to one another. It can be particularly advantageous for both ends of the angled snap-fit hook to be connected to the connection installation.

A snap-fit hook that is configured so as to be angled, when viewed in a plan view, can preferably have the shape of the letter "L" or that of the number "7", respectively. The snap-fit hook can preferably have two portions that run so as to be substantially mutually orthogonal, or at a right angle, respectively. The snap-fit hook in this case can preferably be disposed in such a manner that one of the portions, preferably the longer portion, extends in the plug-fitting direction. The other portion, preferably the shorter portion, herein can preferably extend so as to be parallel with the guide between the connection installation element and the housing. It is preferably provided herein that one end of this portion, specifically preferably the end which has the angle for continuing the second portion, bears on the detent face of the housing when the plug connection is not closed. The other end of this portion which preferably extends from the detent face of the housing toward the top, is preferably connected to an activation face which, when the connection installation element is configured so as to be U-shaped, can be a face which bridges the two legs of the U-shaped connection installation. It is achieved on account thereof, that a force which is exerted on the activation face and which would in principle be suitable for undesirably moving the connection installation element from the unlocking position to the locking position, is introduced from the activation face by way of the portion of the snap-fit hook directly into the bearing face of the housing, when the plug connection is not closed. This results in that a force acting on the activation face does not lead to the snap-fit hook being bent or pushed apart in such a manner that said snap-fit hook unintentionally releases the unlocking position. A displacement of the connection installation element from the unlocking position to the locking position is possible only once the unlocking element of the housing of the second plug connector activates the snap-fit hook, preferably pushes outward the portion of the snap-fit hook that extends in the plug-fitting direction.

The securing member, in particular in a design embodiment as a snap-fit hook, is preferably molded, cut out, punched, from a wall of the connection installation, or is at least produced so as to be integral to the wall, for example by respective injection-molding methods. Alternatively, the snap-fit hook or hooks can also be configured so as to be separate from the wall of the connection installation.

Optionally, combinations of different securing members, or snap-fit hooks, can be provided in the use of a plurality of securing members, for example a snap-fit hook having a linear profile, and a snap-fit hook having an angled profile.

In one refinement of the invention it can be provided that the guide between the housing of the first plug connector and the connection installation element extends at an angle of 45° to 90° in relation to the plug-fitting direction, preferably at an angle of 90° (that is to say orthogonally in relation to the plug-fitting direction) for plugging the two plug connectors to one another.

Alternatively, a guide having an arbitrary linear or curved profile can be provided. However, a guide having an orthogonal and linear profile can be advantageous for constructive reasons.

In one refinement it can be provided that the guide between the housing of the first plug connector and the connection installation element is configured as a rail system, preferably as a T-rail system, or an L-rail system, or a tongue-and-groove connection, and particularly preferably as a dovetail connection.

In particular a dovetail connection, or a rail system which captively holds the sidewalls of the connection installation element within the guide in at least two directions, respectively, has proven particularly advantageous. A dovetail guide can preferably also in particular prevent the preferably U-shaped connection installation element from laterally springing open.

In one refinement of the invention it can be provided that the first gate part is configured as a positive guide, and the second gate part is configured as a gate block.

Of course, an embodiment in which the second gate part is configured as a positive guide, and the first gate part is configured as a gate block is also possible.

In the case of a plurality of gate guides, for example two gate guides on opposite sides of the plug connectors, being used, it can also be provided that a gate block is provided on one leg of the connection installation, and a positive guide is provided on the opposite leg, wherein the second plug connector to this end is configured in a corresponding, that is to say a complementary, embodiment.

The gate block can preferably be configured in the manner of a pin which laterally protrudes from the housing of the second plug connector.

In the plug-fitting direction, the positive guide can preferably have an opening, a positioning system region, or similar, so as to enable a ready intrusion of the gate block into the positive guide when the plug connectors are plugged to one another in the preliminary latching position.

In one preferred refinement it can be provided that the positive guide, in the region in which the gate block is located when the positive guide and the gate block are in the second mutually relative position, has a receptacle, preferably a form-fitting receptacle, particularly preferably a snap-fit receptacle, and most particularly preferably a C-shaped snap-fit receptacle, for the gate block.

On account of the positive guide having a form-fitting receptacle at the second position, fixing the second plug connector to the first plug connector in the terminal position can at least be supported or optionally implemented solely by the connection installation. Alternatively or additionally, the connection installation element can also be fixed in the locking position by another mechanical latching arrangement.

In particular in the case of a configuration of the receptacle as a snap-fit receptacle, the plug connection can assume the terminal position in a self-acting manner by snap-fitting the gate block in the snap-fit receptacle. The susceptibility of the plug connection to errors is thus further reduced. Furthermore, the assembly technician can receive a tactile and optionally also acoustic feedback signal of the plug connection, on account of which the assembly technician receives a feedback that the electrical and mechanical connection is closed in the desired manner.

In one refinement it can be provided that the connection installation element on an upper side that faces away from the housing of the first plug connector has an activation face so as to be able to apply a compressive force on the connection installation element in order for the connection installation element to be displaced along the guide from the unlocking position to the locking position.

The activation face can preferably be configured so as to be structured. Moreover, the activation face in this instance can also be readily found by an assembly technician without visual contact.

The first plug connector, or the housing of the first plug connector, respectively, the second plug connector, or the housing of the second plug connector, respectively, and the connection installation element can be designed in different color shades, on account of which an assembly technician can visually check a state of the mechanical or electrical connection, respectively, as simply as possible, and can differentiate, for example, whether the plug connection is in the preliminary latching position or in the terminal position. This can optionally also be readily identified in particular in that a design is selected in which the clearance on account of the positive guide can be predefined in the form of a clearance or of a window, on account of which the view in the preliminary latching position of a housing part of the plug connectors having two different colors is exposed, while only one color, preferably of a housing part, is still identifiable in the clearance, or the window, respectively, when the terminal position is reached.

Exemplary embodiments of the invention will be described in more detail hereunder by means of the drawings.

The drawings show preferred exemplary embodiments in which individual features of the present invention are illustrated in combination with one another. The features of one exemplary embodiment are also implementable independently of the other features of the same exemplary embodiment, and can accordingly be combined by a person skilled in the art with features of other exemplary embodiments so as to form further purposeful combinations and subcombinations.

DETAILED DESCRIPTIONS OF PREFERRED EMBODIMENTS

Figure 1:
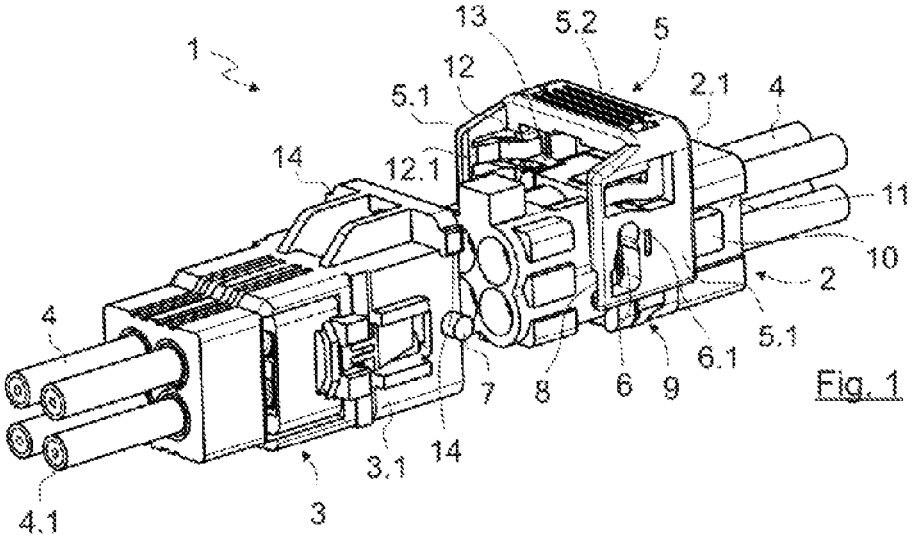
FIG. 1 shows an embodiment of a plug connection apparatus according to the invention having a first plug connector, a second plug connector, and a connection installation, in an unplugged state, in an isometric illustration.

A plug connection apparatus 1 having a first plug connector 2 and a second plug connector 3 which, for establishing a mechanical and electrical connection, are capable of being plugged to one another is shown in an isometric illustration in FIG. 1.

The plug connectors 2, 3 in an exemplary manner are illustrated in an embodiment as coaxial plug connectors for connecting four cables 4 having inner conductors 4.1.

Of course, in the context of the invention an arbitrary plug connection 1 having an arbitrary number of cables 4, or inner conductors 4.1, respectively, to be connected can be provided.

The invention in the exemplary embodiment is shown by means of a HFM-compatible plug connection 1. However, the invention is not to be understood as being limited to this plug connection standard.

In the exemplary embodiment, the first plug connector 2 is configured as a coupler 2, and the second plug connector 3 is configured as a plug 3. In principle, however, each of the plug connectors 2, 3 can be configured as a plug, an installation plug, a coupler, a socket, or an adapter.

The plug connection 1 illustrated furthermore has an additional connection installation element 5 which for supporting the connection of the plug connectors 2, 3 is disposed on a housing 2.1 of the first plug connector 2.

The connection installation element 5 in the exemplary embodiment is configured so as to be U-shaped and is attached to the housing 2.1 of the first plug connector 2. In each case a first gate part 6 which is a positive guide 6 is configured on both legs 5.1 of the U-shaped connection installation element 5. Of course, a first gate part 6 in an arbitrary embodiment can also be provided only on one side, or on one leg 5.1, respectively, or else at an arbitrary position of the connection installation element 5.

A housing 3.1 of the second plug connector 3 furthermore has on both sides in each case one second gate part 7 which is configured as a gate block 7, or as a pin, respectively.

Figure 8:
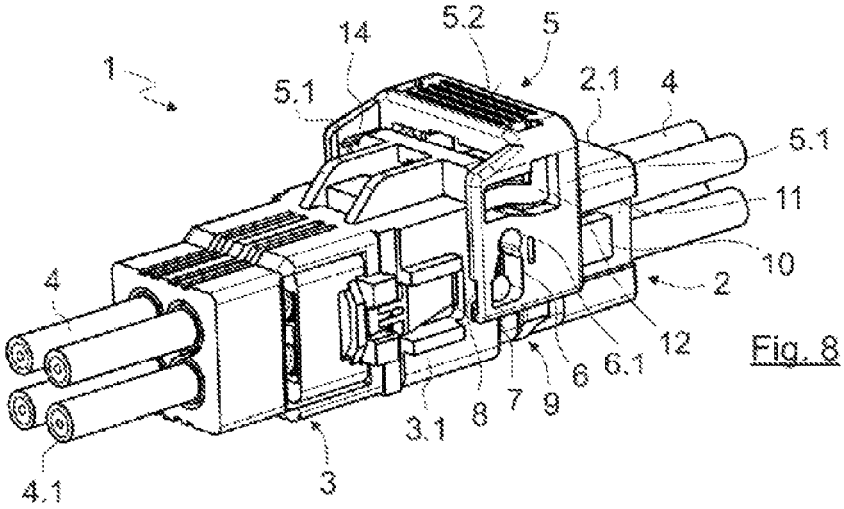
FIG. 8 shows an embodiment of a plug connection apparatus according to the invention in the preliminary latching position, in an isometric illustration.

The positive guide 6 of the connection installation element 5, and the gate block 7 of the housing 3.1 of the second plug connector 3 configure a gate guide, wherein the two gate parts 6, 7 assume a first mutually relative position when the plug connectors 2, 3 are plugged to one another in a preliminary latching position. The preliminary latching position and thus also the first mutually relative position of the gate parts 6, 7 are illustrated in FIG. 8. When the plug connectors 2, 3 are plugged to one another, the gate block 7 is introduced into the positive guide 6 through an opening 8 or a positioning system region of the connection installation element 5, said gate block 7 subsequently being in the first position relative to the positive guide 6.

Figure 13:
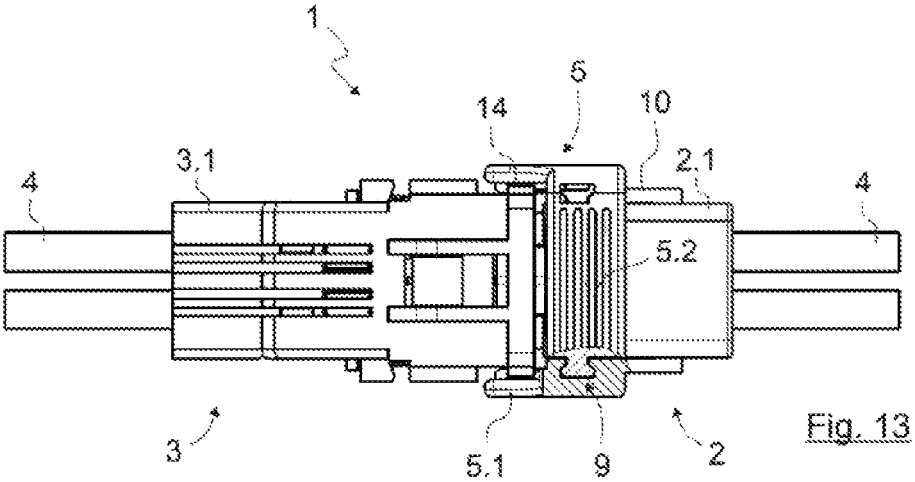
FIG. 13 shows an embodiment of a plug connection apparatus according to the invention in the preliminary latching position, in a partially sectioned plan view according to the line B-B of FIG. 11.

The connection installation element 5 is connected to the housing 2.1 of the first plug connector 2 by way of a guide 9 (cf. also FIG. 13).

In the exemplary embodiment, two guides 9, that is to say one guide 9 on each leg 5.1, are provided.

Figure 9:
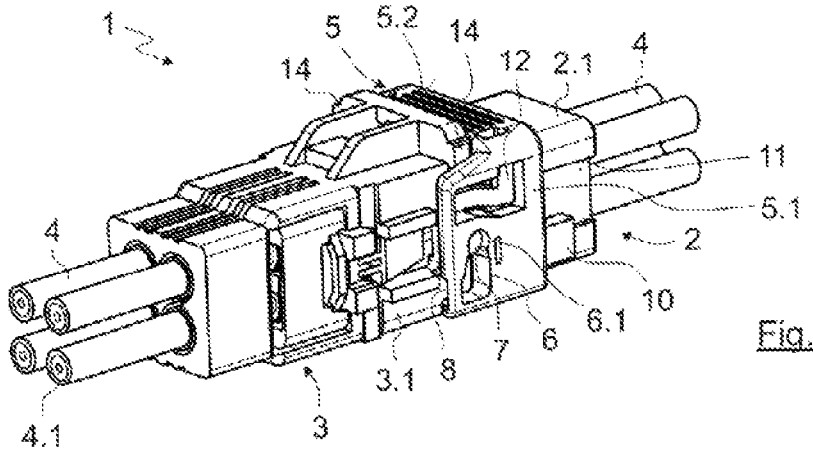
FIG. 9 shows an embodiment of a plug connection apparatus according to the invention in the terminal position, in an isometric illustration.

The plug connectors 2, 3 by way of the guide 9 and the gate guide (by the gate parts 6, 7) are mechanically coupled in such a manner that the plug connectors 2, 3 are plugged to one another in a terminal position when the two gate parts 6, 7 are in a second mutually relative position. The terminal position of the plug connection 1 and thus also the second mutually relative position of the gate parts 6, 7, are illustrated in FIG. 9. The gate block 7 herein is in the upper position of the positive guide 6.

The second position of the gate guide can be a position in which the gate block 7 is located at that end of the positive guide 6 that is opposite the opening 8 of the positive guide 6.

The first and the second position are disposed so as to be offset in the plug-fitting direction of the plug connectors 2, 3.

Figure 10:
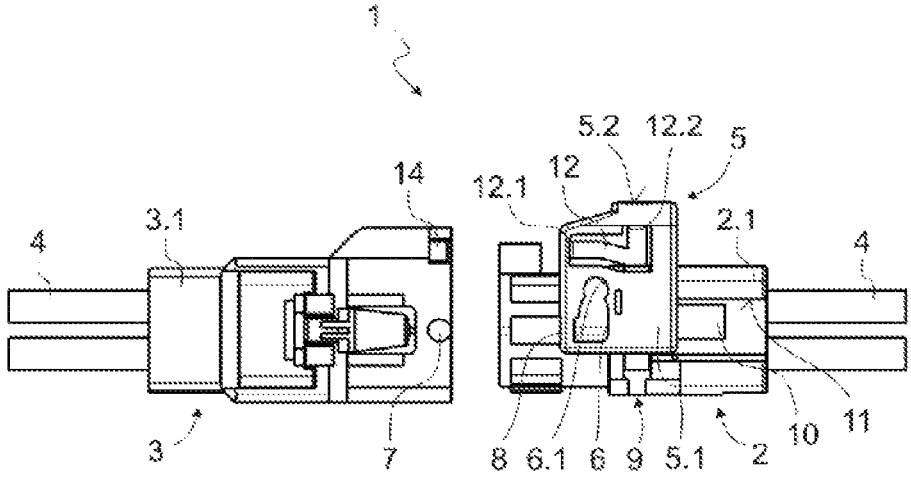
FIG. 10 shows an embodiment of a plug connection apparatus according to the invention in the unplugged state, in a lateral view.
Figure 11:
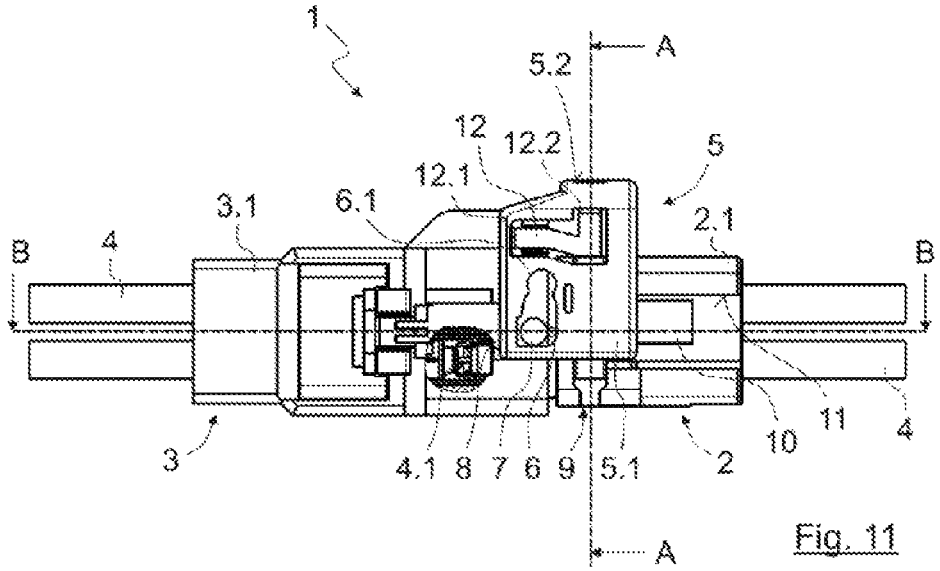
FIG. 11 shows an embodiment of a plug connection apparatus according to the invention in the preliminary latching position, in a lateral view.
Figure 12:
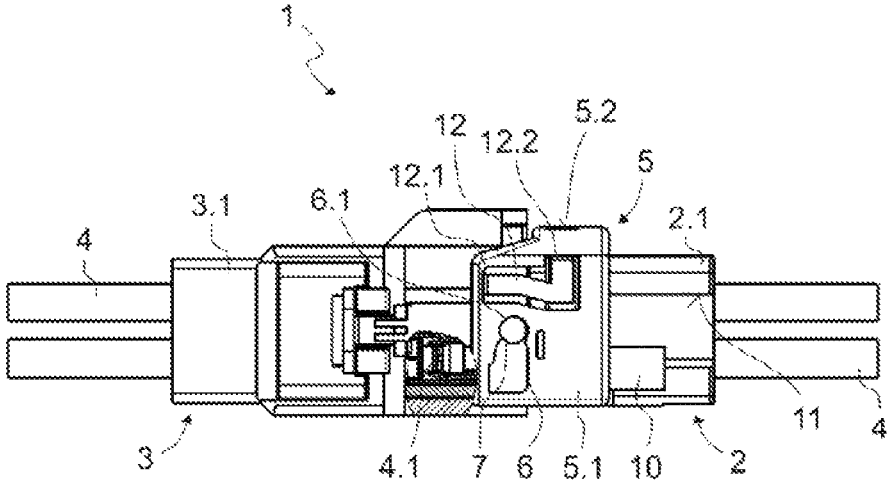
FIG. 12 shows an embodiment of a plug connection apparatus according to the invention in a terminal position, in a lateral view.

According to the invention, the connection installation element 5 by way of the positive guide 6 is displaceable along the guide 9, relative to the housing 2.1 of the first plug connector 2, from an unlocking position (position of the connection installation element 5 as shown in FIGS. 1, 8, 10, 11, and 14) to a locking position (position of the connection installation element 5 as shown in FIGS. 9 and 12), so as to displace the two gate parts 6, 7 to the second position.

In the exemplary embodiment, the guide 9 runs between the housing 2.1 of the first plug connector 2 and the connection installation element 5 runs orthogonally to the plug-fitting direction of the plug connectors 2, 3. When the plug connectors 2, 3 are thus plugged to one another in the preliminary latching position, and the connection installation element 5 subsequently is pushed down along the guide 9, orthogonally to the plug-fitting direction, the mechanical coupling (gate guide) between the second plug connector 3 and the connection installation element 5, and the connection installation element 5 and the housing 2.1 of the first plug connector 2 (by way of the guide 9) leads to the gate guide converting the orthogonal movement of the connection installation element 5 to a movement of the plug connectors 2, 3 along the plug-fitting direction in such a manner that the plug connectors 2, 3 are moved, or plugged to one another, respectively, to the terminal position.

The procedure of the plugging to one another is illustrated in a lateral view in FIGS. 10, 11, and 12.

The opened plug connection 1 is shown in FIG. 10. The connection installation element 5 herein is fixed in the unlocking position thereof and is thus already in a suitable position for receiving the second gate part 7, or the second plug connector 3, respectively.

The plug connectors 2, 3 in FIG. 11 are in the preliminary latching position, wherein the gate block 7 is already introduced into the positive guide 6 of the connection installation element 5. While the plug connectors 2, 3 in the exemplary embodiment are optionally already interconnected mechanically by way of the respective housings 2.1, 3.1 of said plug connectors 2, 3, the electrical connection, in particular the electrical connection of the inner conductors 4.1, is not yet sufficiently guaranteed with adequate quality. A partial section is illustrated for clarification in FIG. 11. It can be seen herein that a spacing remains between the plug connectors 2, 3, this resulting in the inner conductors 4.1 of the second plug connector 3 being not yet fully plugged into the inner conductor receptacle of the first plug connector 2, on account of which an electromagnetic compatibility of the plug connection 1 and a vibration resistance, and a desired low impedance are not yet provided under certain circumstances.

It is to be noted at this point that a mechanical connection of the housings 2.1, 3.1 of the plug connectors 2, 3 in the preliminary latching position as is illustrated in the exemplary embodiment is not required. A preliminary latching position in the context of the invention can also be present when there is no mechanical connection between the housings 2.1, 3.1, or there is indeed a mechanical connection but the latter does not yet lead to any electrical contact and/or does not yet keep together the housings 2.1, 3.1, respectively.

The plug connection 1 in FIG. 12 is illustrated completely assembled, that is to say that the plug connectors 2, 3 are in the terminal position, the connection installation element 5 is in the locking position, and the gate parts 6, 7 are in the second mutually relative position. In the partial section herein it can be seen that the inner conductors 4.1 are now fully plugged in, or plugged in at the provided position, respectively.

The connection installation element 5 on the upper side that faces away from the housing 2.1 of the first plug connector 2 has an activation face 5.2 so as to be able to apply a compressive force on the connection installation element 5 in order for the connection installation element 5 to be displaced, or pushed, respectively, along the guide 9 from the unlocking position to the locking position.

The activation face 5.2 herein is configured so as to be structured, so as to offer a better grip to an assembly technician when activated, for example.

The connection installation element 5 in the implementation according to the invention, in particular by virtue of the guide and of the gate guide, has the advantage that the plug connectors 2, 3 can be produced by way of a comparatively minor effort in terms of force, that is to say by way of a comparatively minor force which has to be applied by the assembly technician to the activation face 5.2. The effort in terms of force for plugging the plug connectors 2, 3 to one another from the preliminary latching position to the terminal position without the implementation by way of the guide 9 and of the gate guide would otherwise be significantly higher.

In the exemplary embodiment, the positive guide 6 in the region in which the gate block 7 is in the second position, has a receptacle 6.1, which is preferably configured as a C-shaped snap-fit receptacle, for the gate block 7. When the connection installation element 5 is activated in the envisaged manner, that is to say is displaced along the guide 9 from the unlocking position in the direction of the locking position, the gate block 7 thus snaps into the C-shaped snap-fit receptacle 6.1 and is sufficiently locked therein. On account thereof, an assembly technician can receive a tactile feedback signal, for example, according to which he/she can assume that the plug connection 1 is closed and fixed in a defined manner.

It can be provided that the plug connectors 2, 3 if required, are separated again. To this end, a flat object, for example a screwdriver, can be introduced from the rear into the connection installation element 5, between the connection installation element 5 and the housing 2.1 of the first plug connector 2, so as to subsequently release the connection installation element 5 by levering the latter from the locking position thereof.

In the exemplary embodiment, the connection installation element 5 is captively connected to the first plug connector 2.

The connection installation element 5 in the exemplary embodiment has one detent element 10 in the manner of a lug, a protrusion, or a tab that protrudes from the connection installation element 5 on each leg 5.1. In a manner corresponding thereto, the housing 2.1 of the first plug connector 2 on both sides has in each case one detent 11 so as to delimit a movement of the connection installation element 5 along the guide 9, counter to unlocking position, in a direction that faces away from the locking position.

The detent element 10 illustrated, by impacting the detent 11 of the housing 2.1 of the first plug connector 2 herein prevents that the connection installation element 5 in the exemplary embodiment can be pulled upward, or raised, respectively, by the first plug connector 2. Alternatively, it can also be provided that the guide 9 per se has a type of terminal detent.

The design of the detent element 10 and of the detent 11 shown in the exemplary embodiment enables a particularly simple assembly of the connection installation element 5 on the housing 2.1 of the first plug connector 2. The connection installation element 5 configured so as to be U-shaped can be attached in a simple manner to the housing 2.1 (from above, when viewed in the exemplary embodiment) and be push-fitted onto the housing 2.1 so far until the detent element 10 has overcome the detent 11 and, after overcoming the detent 11, latches in a corresponding manner such that a movement in the opposite direction is prevented by the detent element 10 of the connection installation element 5 and by the detent 11 of the housing 2.1. The assembly of the connection installation element 5 on the housing 2.1 herein is performed in such a manner that the connection installation element 5 is threaded into the guide 9, or is displaced along the latter, respectively, so as to assemble the connection installation element 5 on the housing 2.1.

The detent 11 in the housing can be produced in a particularly simple manner in that the housing 2.1 has a recess, a shoulder, a step, or a depression, the edge of the latter then configuring the detent 11 for the detent element 10, as is illustrated in the FIGS.

The configuration of the detent element 10 as a lug, protrusion, or tab which preferably projects beyond the connection installation element 5 counter to the plug-fitting direction leads to the detent element 10, when assembling the connection installation element 5 on the housing 2.1, being able to be particularly advantageously bent open or bent outward, respectively, so that said detent element 10 can overcome the detent 11 of the housing 2.1.

In the activation direction of the connection installation element 5 from the unlocking position to the locking position, the movement of the connection installation element 5 is delimited by the U-shaped configuration of the connection installation element 5. Any loss of the connection installation element 5 along or counter to the plug-fitting direction in the exemplary embodiment is prevented by the guide 9.

In one particularly preferred embodiment such as illustrated in the exemplary embodiment, the connection installation element 5 furthermore has a securing member 12, and the housing 2.1 of the first plug connector 2 has at least one detent face 13, wherein the detent face 13 in the unplugged state of the plug connectors 2, 3 prevents a movement of the connection installation element 5 from the unlocking position in the direction toward the locking position, since the securing member 12 in this instance is located in the displacement path, and any displacement is blocked by the detent face 13.

The securing member 12 in the exemplary embodiment is configured as a snap-fit hook 12, preferably designed so as to be bent, or stepped, or having kinks, respectively. The snap-fit hook 12 is pretensioned in such a manner that the snap-fit hook 12 in the unplugged state of the plug connectors 2, 3 bears on the detent face 13 of the housing 2.1 of the first plug connector 2. The snap-fit hook 12 in the exemplary embodiment, by way of at least one section, extends inward and thus bears on the detent face 13. In order for a particularly robust securing member 12 to be provided, both ends 12.1, 12.2 of the snap-fit hook 12 are connected to the connection installation element 5.

The second plug connector 3 in the exemplary embodiment, in each case has unlocking elements 14 at corresponding positions on both sides, said unlocking elements 14 being disposed and configured in such a manner that the unlocking elements 14, when plugging to one another the plug connectors 2, 3, move or bend open, respectively, the snap-fit hooks 12 in such a manner that the detent faces 13 of the housing 2.1 of the first plug connector 2 are no longer located in the displacement path of the connection installation element 5 from the unlocking position to the locking position.

The unlocking elements 14 herein can preferably push apart the regions of the corners of a snap-fit hook 12.

Figure 14:
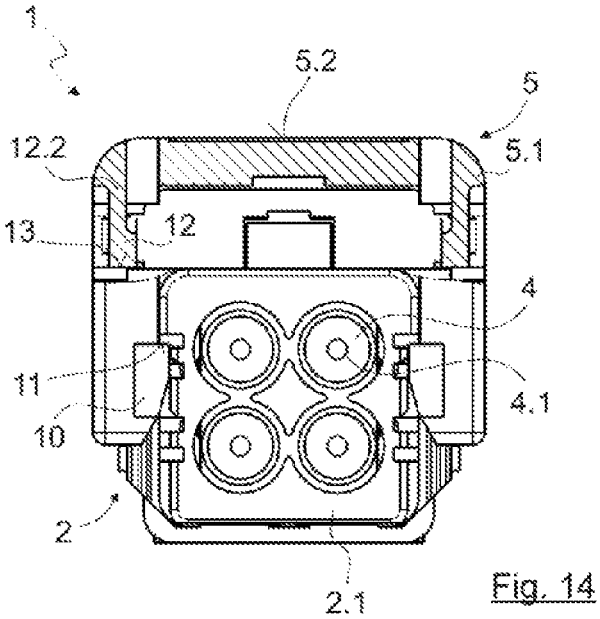
FIG. 14 shows an embodiment of a plug connection apparatus according to the invention in an enlarged rearward partially sectioned illustration according to the line A-A of FIG. 11.

The snap-fit hooks 12 together with the plug connection 1 can be particularly readily seen in FIGS. 1 and 14. The snap-fit hooks 12 in both FIGS. are in the securing position thereof, that is to say are located in the displacement path of the connection installation element 5 from the unlocking position to the locking position. The first plug connector 2 is illustrated in a rear view in FIG. 14, by way of a partial section through the connection installation element 5 along the section line A-A in FIG. 11, on account of which the snap-fit hook 12 becomes visible.

FIGS. 2 to 7 are intended to further clarify the functional mode and potential embodiments of the securing member or the snap-fit hook 12, respectively.

Figure 2:
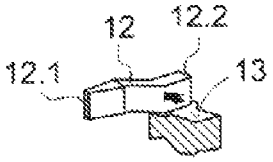
FIG. 2 shows a securing member in the configuration of a snap-fit hook when locked with a detent face of the housing of the first plug connector.
Figure 3:
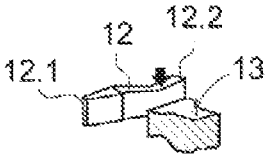
FIG. 3 shows a securing member in the configuration of a snap-fit hook when unlocked with a detent face of the housing of the first plug connector.

A simple snap-fit hook 12 is schematically shown in an isometric illustration in FIG. 2. The snap-fit hook 12 herein on one side, at the first end 12.1 thereof, is fixedly connected to the connection installation element 5 (not illustrated here). The snap-fit hook 12 is configured so as to be elastic and in the basic position thereof is disposed in the displacement path of the connection installation element 5, that is to say said snap-fit hook 12 bears on the detent face 13 of the housing 2.1 of the first plug connector 2 (not illustrated in more detail here). If a force is now exerted along the direction of the arrow illustrated in FIG. 2, for example by way of an unlocking element 14 which is pushed in along the plug-fitting direction, the snap-fit hook 12 can be conveyed out of the securing position of the latter. The connection installation element 5 can subsequently be displaceable along the guide 9, from the unlocking position to the locking position of said connection installation element 5 (cf. direction of the arrow in FIG. 3). The snap-fit hook 12 herein is illustrated in FIG. 3 as being released and displaced along the movement direction of the guide 9.

Figure 4:
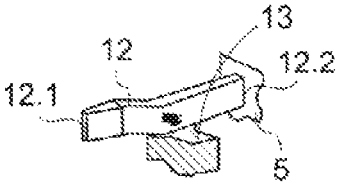
FIG. 4 shows a further securing member in the configuration of a snap-fit hook when locked with a detent face of the housing of the first plug connector.
Figure 5:
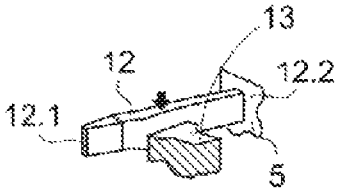
FIG. 5 shows a further securing member in the configuration of a snap-fit hook when unlocked with a detent face of the housing of the first plug connector.

A further snap-fit hook 12 is schematically shown in FIGS. 4 and 5, wherein the snap-fit hook 12 at both ends 12.1, 12.2 is connected to the connection installation element 5. The snap-fit hook 12 becomes more robust on account thereof. The functionality as illustrated is nevertheless still provided, for example in that the snap-fit hook 12 is deformed (cf. FIG. 5).

Figure 6:
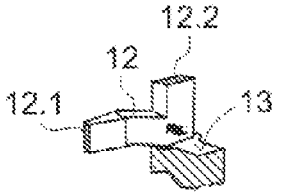
FIG. 6 shows a securing member in the configuration of a snap-fit hook with an angular profile, when locked with a detent face of a housing of the first plug connector.
Figure 7:
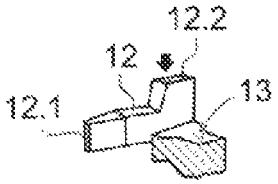
FIG. 7 shows a securing member in the configuration of a snap-fit hook with an angular profile, when unlocked with a detent face of the housing of the first plug connector.

The particularly preferred embodiment of the snap-fit hook 12 in an angled form, as is implemented in the exemplary embodiment, is illustrated in FIGS. 6 and 7. The snap-fit hook 12 herein is likewise fixedly connected to the connection installation element 5 at both ends 12.1, 12.2. The snap-fit hook 12, in particular on account of this embodiment, can be configured so as to be extremely resistant in relation to an undesirable force acting along the movement direction of the guide 9. Any undesirable unlocking can be prevented on account thereof. The angled snap-fit hook 12 in the form thereof can be similar to the tilted number "7" or to the lying letter "L".

As can be seen in particular from FIG. 6, a compressive force which acts, for example, by way of the activation face 5.2 by way of the portion (running vertically in the image plane) between the end 12.2 and the detent face 13 is introduced directly into the detent face 13 of the housing 2.1. A compressive force on the activation face 5.2, when the snap-fit hook 12 is not yet outwardly deflected, thus only leads to the force by way of the corresponding portion of the snap-fit hook 12 being introduced directly into the detent face 13. There is thus no risk of the snap-fit hook 12 being bent open.

The guide 9 between the connection installation element 5 and the housing 2.1 of the first plug connector 2 is illustrated in a plan view in FIG. 13. FIG. 13 herein shows a partial section along the section line B-B of FIG. 11. The guide 9 in the exemplary embodiment is embodied as a dovetail connection 9. A dovetail connection 9 has proven to be particularly advantageous since the legs 5.1 of the U-shaped connection installation element 5, on account thereof, are movable so as to be guided along the housing 2.1 of the first plug connector 2. Even when an excessive stress arises on the plug connection 1, a lateral bending open of the legs 5.1 is largely prevented. On account thereof, the plug connection 1 is exceptionally robust.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. An electrical plug connection apparatus, comprising:

a first plug connector having a first housing, the first housing having at least one detent face;

a second plug connector having a second housing and an unlocking element on the second housing; and, a connection installation element connected to the first housing by way of at least one guide for guiding displacement of the connection installation element relative to the first housing between an unlocking position and a locking position, the connection installation element having at least one first gate part and at least one securing member;

the first plug connector and the second plug connector being connectable to one another from an unplugged state to a plugged-together state through relative movement of the first plug connector and the second plug connector toward one another in a plug-fitting direction to a preliminary latching position and further relative movement of the first plug connector and the second plug connector toward one another in the plug-fitting direction from the preliminary latching position to a terminal position;

the second housing of the second plug connector having at least one second gate part, the first gate part and the second gate part being in a first mutually relative position when the first plug connector and the second plug connector are in the preliminary latching position;

wherein the securing member engages the detent face of the first housing when the first plug connector and the second plug connector are in the unplugged state and the engagement between the securing member and the detent face blocks the displacing of the connection installation element from the unlocking position to the locking position;

wherein, the unlocking element disengages the at least one securing member from the detent face to permit displacement of the connection installation element from the unlocking position to the locking position and, when the first plug connector and the second plug connector are in the preliminary latching position, the first plug connector and the second plug connector are mechanically coupled to one another by way of the guide, the first gate part and the second gate part such that the displacing the connection installation element from the unlocking position to the locking position moves first gate part and the second gate part from the first mutually relative position to a second mutually relative position and moving the first gate part and the second gate part from the first mutually relative position to the second mutually relative position causes the further relative movement of the first plug connector and the second plug connector toward one another in the plug-fitting direction from the preliminary latching position to the terminal position.

2. A plug connection apparatus as claimed in claim 1, wherein the connection installation element is captively connected to the first plug connector.

3. A plug connection apparatus as claimed in claim 1, wherein the connection installation element has at least one detent element and the first housing of the first plug connector has at least one detent which interacts with the detent element to delimit the displacement of the connection installation element in a direction of the displacement of the connection installation element between the unlocking position and the locking position.

4. A plug connection apparatus as claimed in claim 1, wherein the securing member comprises a snap-fit hook which is pretensioned such that, in the unplugged state, at least a part of the snap-fit hook bears on the detent face of the first housing of the first plug connector.

5. A plug connection apparatus as claimed in claim 4, wherein the snap-fit hook has a first end and a second end and both the first end and the second end of the snap-fit hook are connected to the connection installation element.

6. A plug connection apparatus as claimed in claim 1, wherein the guide guides the displacement of the connection installation element in a second direction which is at an angle of 45° to 90° to the plug-fitting direction.

7. A plug connection apparatus as claimed in claim 1, wherein the guide comprises a rail system.

8. A plug connection apparatus as claimed in claim 1, wherein the first gate part comprises a positive guide and the second gate part comprises a gate block, the gate block being disposed in the positive guide in both the preliminary latching position and the terminal position.

9. A plug connection apparatus as claimed in claim 8, wherein the positive guide includes a snap-fit receptacle in which the gate block is received when the first gate part and the second gate part are in the second mutually relative position.

10. A plug connection apparatus as claimed in claim 1, wherein the connection installation element (5) on an upper side has an activation face that faces away from the first housing of the first plug connector and wherein the connection installation element is displaced from the unlocking position to the locking position by applying a compressive force to the activation face.

11. A plug connection apparatus as claimed in claim 1, wherein the first plug connector and the second plug connector are coaxial plug connectors.

12. A plug connection apparatus as claimed in claim 1, wherein the first plug connector and the second plug are configured for a data connection at high bit rates.

13. A plug connection apparatus as claimed in claim 1, wherein the first plug connector comprises one of: a coupler, a socket, or an adapter.

14. A plug connection apparatus as claimed in claim 13, wherein the second plug connector comprises one of: a plug, an installation plug, or an adapter.

* * * * *